US007823302B2

(12) United States Patent
Mann et al.

(10) Patent No.: US 7,823,302 B2
(45) Date of Patent: Nov. 2, 2010

(54) NOVELTY FOOTWEAR ITEM WITH STORAGE CHEST AND METHOD OF USING SAME

(75) Inventors: Nickolas Aniko Mann, Cincinnati, OH (US); Amy Lynn McMahan, San Marcos, CA (US); Brett D. Ritter, Del Mar, CA (US); James Darr Burress, Del Mar, CA (US); Eric Simmons, San Diego, CA (US)

(73) Assignee: South Cone, Inc

( * ) Notice: Subject to any disclaimer, the term of this patent is extended or adjusted under 35 U.S.C. 154(b) by 761 days.

(21) Appl. No.: 11/811,216

(22) Filed: Jun. 8, 2007

(65) Prior Publication Data

US 2008/0110056 A1 May 15, 2008

Related U.S. Application Data

(63) Continuation-in-part of application No. 11/595,095, filed on Nov. 11, 2006, now abandoned.

(51) Int. Cl.
*A43B 5/00* (2006.01)
*A43B 3/12* (2006.01)

(52) U.S. Cl. ..... 36/136; 36/11.5

(58) Field of Classification Search ..... 36/136, 36/11.5, 1, 30 R, 132
See application file for complete search history.

(56) References Cited

U.S. PATENT DOCUMENTS

| | | | | |
|---|---|---|---|---|
| 32,490 | A | | 6/1861 | Towers |
| 537,492 | A | | 4/1895 | Smith |
| 921,433 | A | | 5/1909 | Miller |
| 922,499 | A | | 5/1909 | Molitor |
| 1,030,085 | A | | 6/1912 | Hale |
| 1,085,254 | A | * | 1/1914 | Halley ..... 36/1 |
| 1,736,827 | A | | 11/1929 | Johnson |
| 1,907,995 | A | | 5/1933 | Nickerson |
| 2,037,970 | A | | 4/1936 | Everston |
| 2,070,814 | A | | 2/1937 | Stemmons |
| 2,208,330 | A | | 7/1940 | Oakley |
| 2,478,411 | A | | 8/1949 | Martin |
| 2,507,991 | A | | 5/1950 | Neal |
| 2,599,740 | A | | 6/1952 | Beveridge |
| 2,897,609 | A | | 8/1959 | Bodkin |
| 2,904,901 | A | | 9/1959 | Goldstein |
| 3,328,900 | A | | 7/1967 | Weitzner |
| 3,800,133 | A | * | 3/1974 | Duval ..... 36/137 |
| 4,845,863 | A | | 7/1989 | Yung-Mao |
| 5,231,776 | A | | 8/1993 | Wagner |
| 5,285,586 | A | | 2/1994 | Goldston et al. |
| 5,438,768 | A | | 8/1995 | Bauerfeind |
| 5,644,858 | A | | 7/1997 | Bemis |
| 5,692,324 | A | | 12/1997 | Goldston et al. |
| 5,921,008 | A | | 7/1999 | Ruff |
| 6,000,147 | A | | 12/1999 | Kellerman |

(Continued)

*Primary Examiner*—Ted Kavanaugh
(74) *Attorney, Agent, or Firm*—Jerry R. Potts

(57) ABSTRACT

A novelty footwear item includes a footbed and a heel-shaped storage unit which has a liftable lid. The footbed and the storage unit are mounted within a wedge-shaped cupsole so that a rear portion of the footbed overlays and conceals the storage unit and pivots up and away from the cupsole in unison with the lid when it is lifted to provide a user access to the heel-shaped storage unit.

20 Claims, 11 Drawing Sheets

U.S. PATENT DOCUMENTS

| | | | | |
|---|---|---|---|---|
| 6,094,844 | A | 8/2000 | Potts | |
| 6,195,920 | B1 | 3/2001 | Morris et al. | |
| 6,243,974 | B1 | 6/2001 | Schaj | |
| 6,453,578 | B1 | 9/2002 | Yung et al. | |
| 6,898,875 | B2 | 5/2005 | Ruff | |
| 7,028,422 | B1 * | 4/2006 | Lewis | 36/136 |
| 7,174,657 | B2 * | 2/2007 | Berg et al. | 36/11.5 |
| 7,418,793 | B2 * | 9/2008 | Dominguez et al. | 36/136 |
| 2007/0193064 | A1 * | 8/2007 | Xu | 36/25 R |

* cited by examiner

FIG. 17
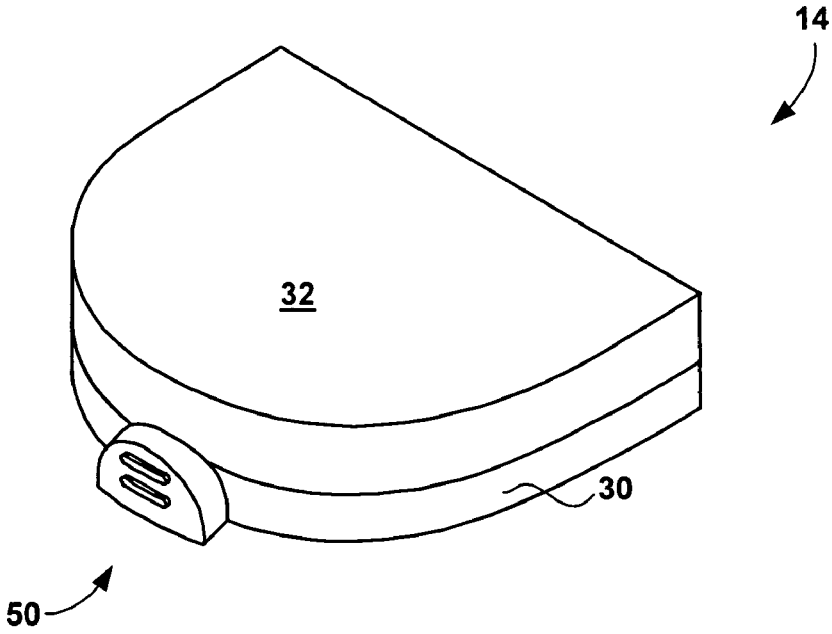
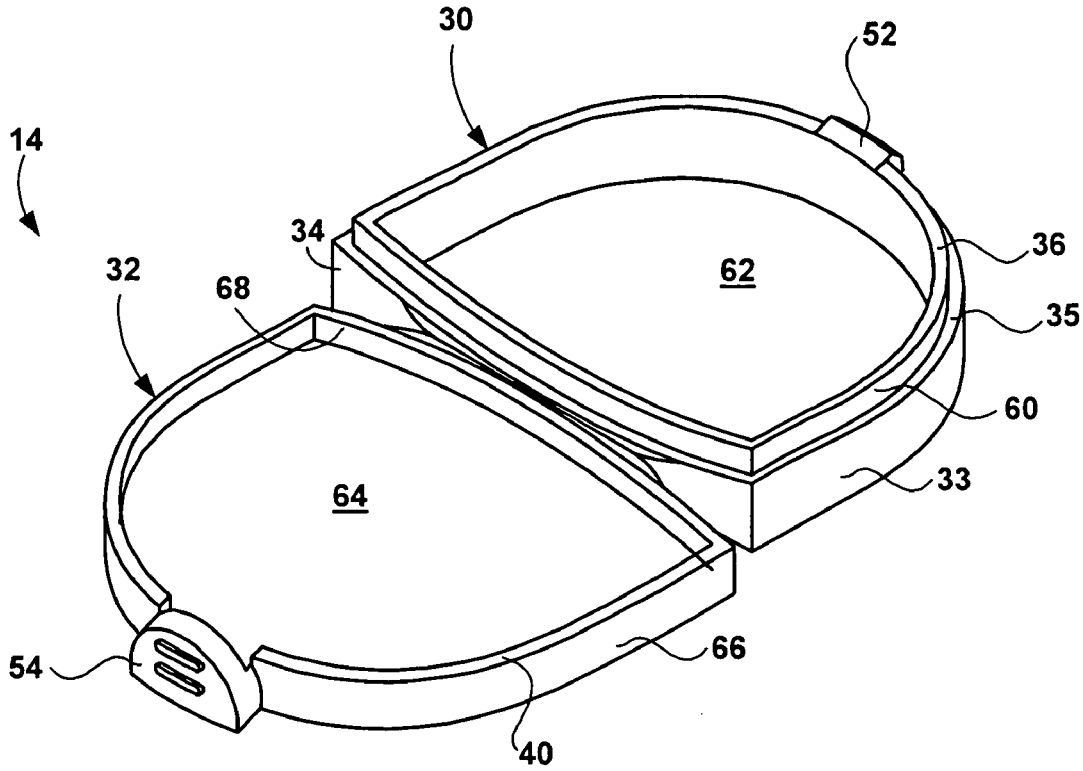
FIG. 18

FIG. 22
FIG. 23
FIG. 24
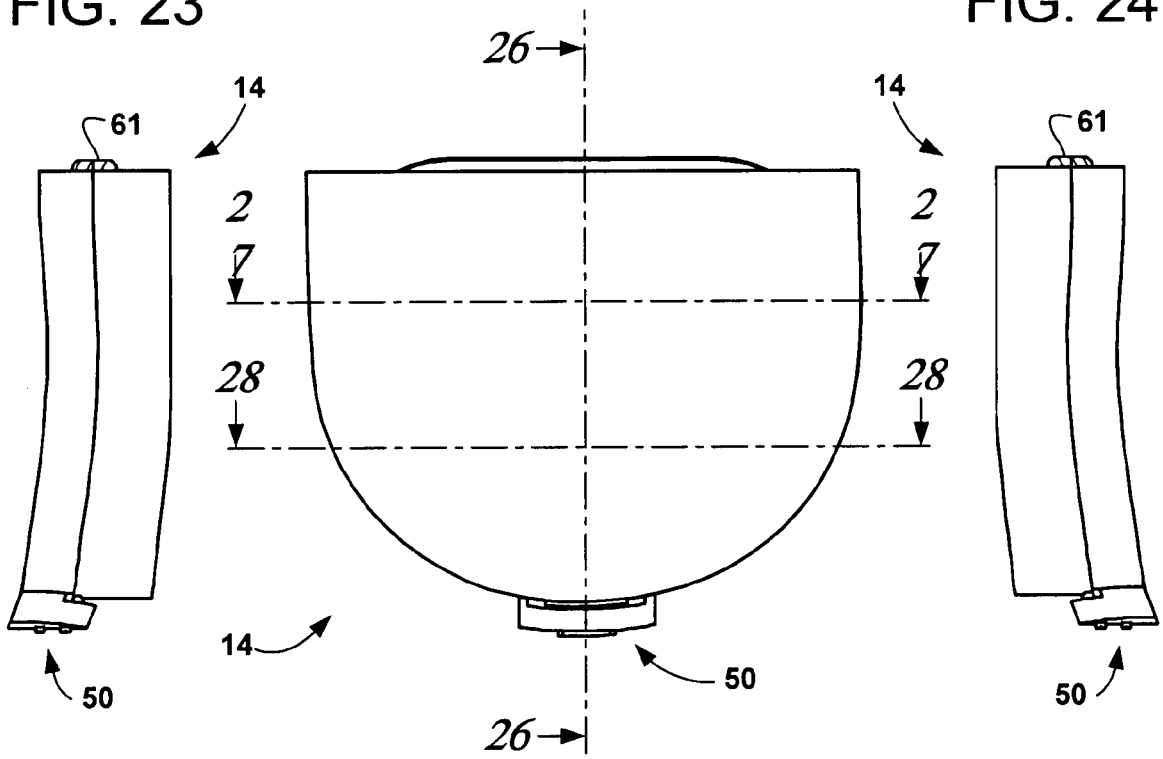
FIG. 25
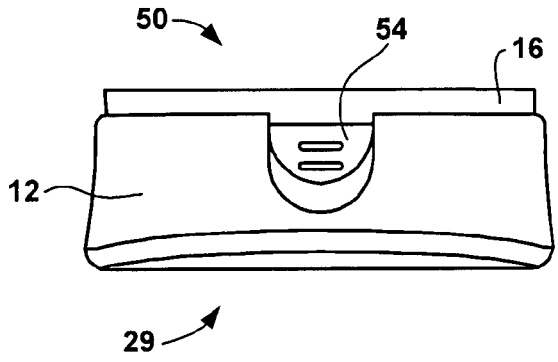

NOVELTY FOOTWEAR ITEM WITH STORAGE CHEST AND METHOD OF USING SAME

RELATED APPLICATIONS

This is a continuation-in-part utility patent application of U.S. patent application Ser. No. 11/595,095 entitled "Novelty Footwear Item With Stash", filed on Nov. 11, 2006 now abandoned, by Brett D. Ritter et al., and is related to U.S. patent application Ser. No. 10/971,187 entitled "Novelty Footwear Item and Method of Using Same" by Nicholas Aniko Mann et al., filed on Oct. 22, 2004, each of the above-mentioned patent applications being assigned to a common owner, South Cone, Inc.

BACKGROUND OF THE INVENTION

This invention relates generally to novelty footwear and a method of using the footwear to conceal small personal items. More particularly the novelty footwear of the present invention includes a footwear construction with a liftable footbed and a heel insert which performs a plurality of functions: in a first and primary function, the heel insert reinforces the heel area of the footwear; in a second and secondary function, the heel insert is constructed as a storage compartment with an attached closure that can be unlocked and lifted up and pivotally away from the storage compartment by lifting the liftable footbed of the footwear; and in a third and final function, the heel insert is contoured to comfortably support the heel of a user on an otherwise flat flexible footbed.

SUMMARY OF THE INVENTION

A novelty footwear item includes a footbed and a heel-shaped storage unit which has a liftable lid. The footbed and the storage unit are mounted within a wedge-shaped cupsole so that a rear portion of the footbed overlays and conceals the storage unit and pivots up and away from the cupsole in unison with the lid when it is lifted to provide a user access to the heel-shaped storage unit.

BRIEF DESCRIPTION OF DRAWINGS

The above-mentioned features and steps of the invention and the manner of attaining them will become apparent, and the invention itself will be best understood by reference to the following description of the embodiments of the invention in conjunction with the accompanying drawings wherein:

FIG. 17 is a perspective view of a storage unit forming part of the novelty footwear item of FIG. 1;

FIG. 18 is another perspective view of the storage unit of FIG. 17, illustrating the storage unit in an opened position;

FIG. 22 is a top plan view of the storage unit of FIG. 17;

FIG. 23 is an outside side elevational view of the storage chest of FIG. 22;

FIG. 24 is an inside side elevational view of the storage chest of FIG. 22;

FIG. 25 is a rear elevational view of the novelty footwear item of FIG. 1;

DETAILED DESCRIPTION OF THE PREFERRED EMBODIMENTS

A footwear item and method for using the footwear item to not only protect the foot of a user but to also provide the user with footwear novelty function auxiliary to the normal footwear function is disclosed. The following description is presented to enable any person skilled in the art to make and use the invention. For purposes of explanation, specific nomenclature is set forth to provide a thorough understanding of the present invention. Descriptions of specific methods and apparatus are provided only as examples. Various modifications to the preferred embodiments will be readily apparent to those skilled in the art, and the general principles defined herein may be applied to other embodiments and applications without departing from the spirit and scope of the invention. Thus, the present invention is not intended to be limited to the embodiments shown, but is to be accorded the widest scope consistent with the principles and features disclosed herein.

Figure 1:
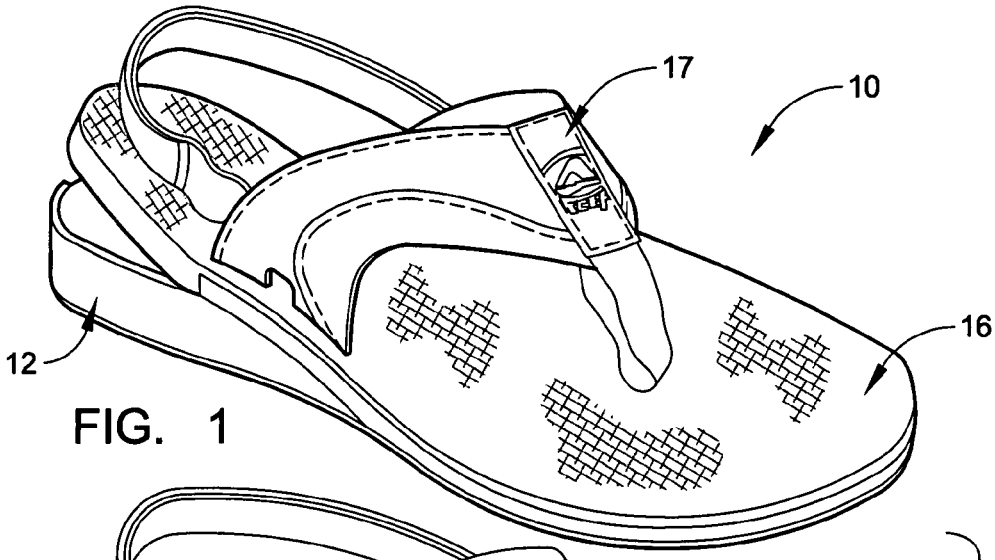
FIG. 1 is a perspective view of a novelty footwear item, which is constructed in accordance with a preferred embodiment the present invention.
Figure 2:
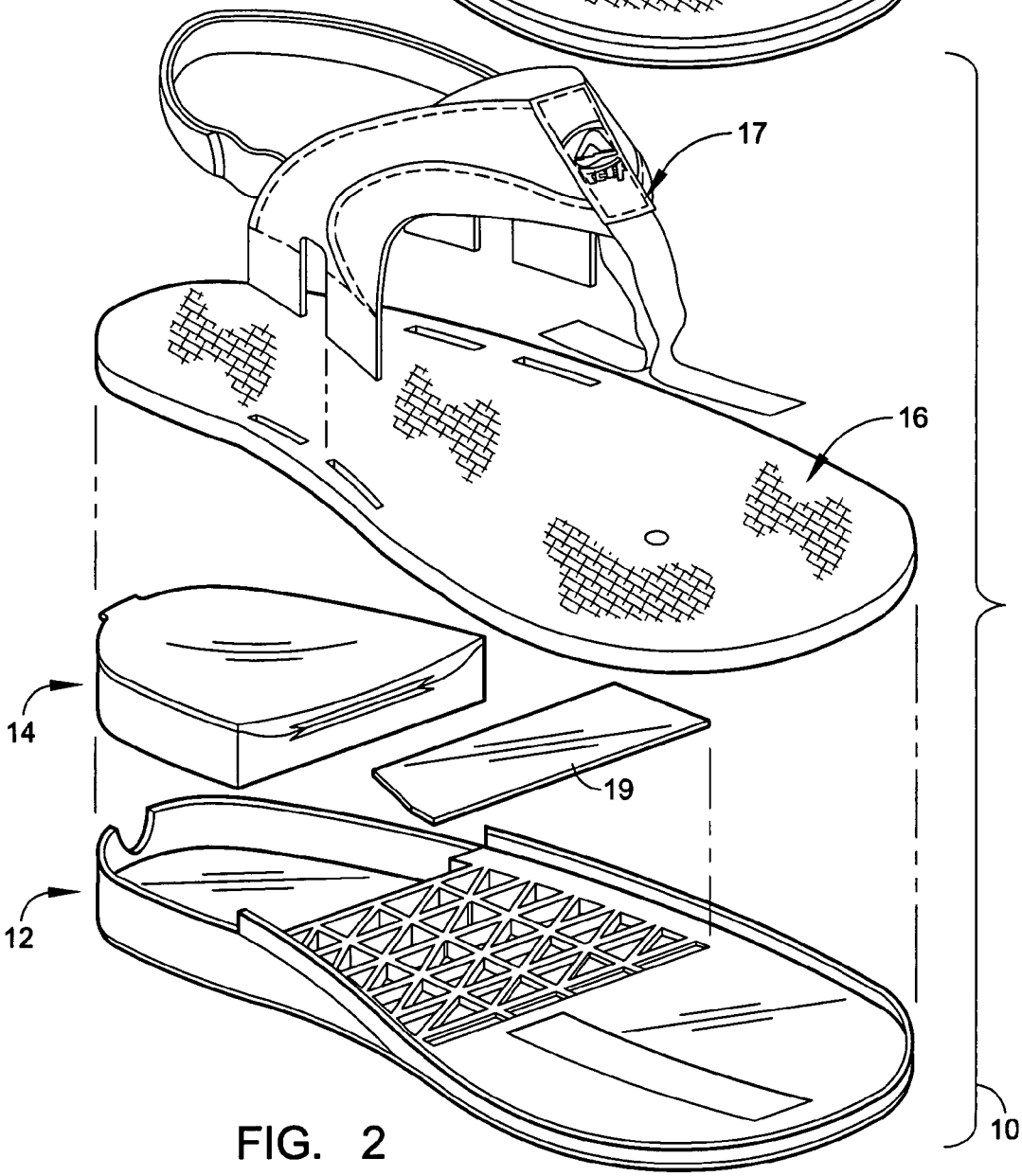
FIG. 2 is an exploded perspective view of the novelty footwear item of FIG. 1.
Figure 3:
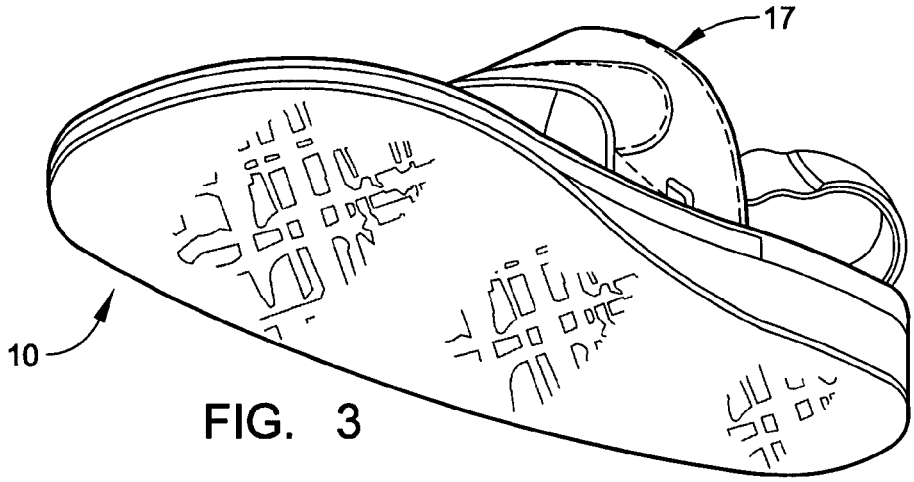
FIG. 3 is another perspective view of the novelty footwear item of FIG. 1 showings its footbed in a lifted position.
Figure 4:
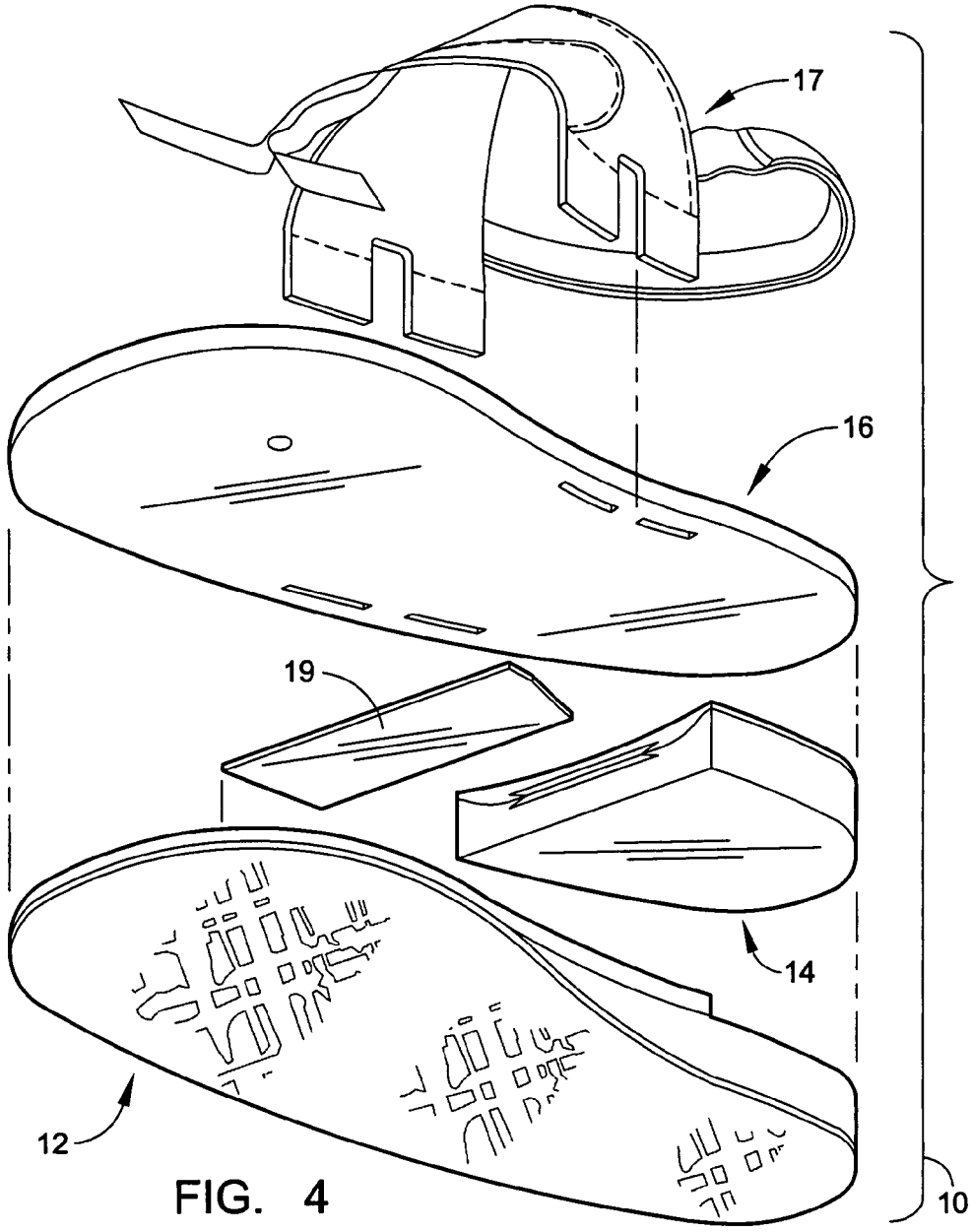
FIG. 4 is another exploded perspective view of the novelty footwear item of FIG. 1.

Referring now to the drawings and more particularly to FIGS. 1-2 there is illustrated a novelty footwear item 10 which is constructed in accordance with a preferred embodiment of the present invention. The novelty footwear item 10 provides a user (not shown) with a reinforced contoured heel area that functions to not only support the heel of the user, but also as a storage space that will not collapse under the load of a user. The novelty footwear item 10 when used in accordance with a novel method of using the footwear item 10, not only protects and supports the foot of the user with an attractive fashion wear appearance but also provides the user with immediate access to a concealed storage space area where small personal items such as coins, keys, and like small items may be stored.

Figure 14:
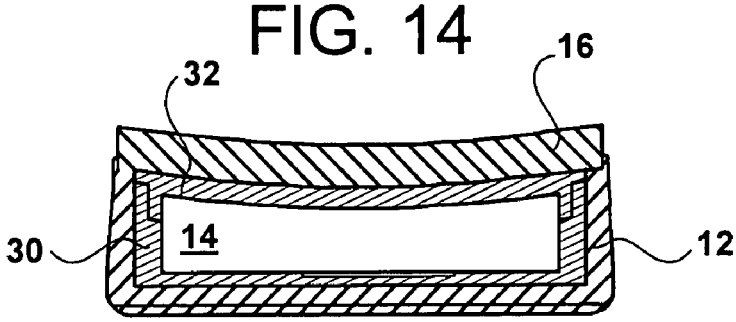
FIG. 14 is a sectional view of the footwear item of FIG. 7, taken substantially along line 14-14 thereof.

Considering the novelty footwear item 10 in greater detail with reference to FIG. 14, the novelty footwear item 10 generally comprises a flexible wedge-shaped cupsole 12 and a hollow load bearing heel insert or support member 14 with a contoured lid or closure 32. The heel insert 14, in this regard, functions as a lockable storage unit within the footwear 10. The heel insert 14 is concealed within the flexible cupsole 12 by a flexible hingeless footbed 16 which is supported from below by the cupsole 12 and the load bearing heel insert 14. A flex inhibiting shank 19 is sandwiched between the cupsole 12 and the footbed 16 to substantially prevent flexing of the cupsole 12 and the footbed 16 into an arch area 15 of the footwear 10 or more particularly, that area starting at the front of the shank 19 and extending rearwardly therefrom into the arch area 15. In this regard, only a front toe area of the footwear 10, indicated generally at 25, flexes under a walking load produced by a user of the footwear 10.

Although the footbed 16 conceals the heel insert 14 and is permanently attached to the cupsole 12 by a non-liftable footbed portion or front footbed portion 16A, a rear footbed portion or liftable footbed portion 16B of the footbed 16 is not affixed to the cupsole 12 but instead, is permanently affixed to the heel insert 14 and is pivotally liftable upwardly and way from the cupsole 12 to reveal a concealed storage space or area (S) within the hollow interior space of a hollow container 30 which forms part of the heel insert 14. This is a unique and novel structure allowing the hingeless footbed 16 to be pivoted about an imaginary line between the non-liftable footbed 16A and the liftable footbed 16B.

From the foregoing, one skilled in the art will appreciate that the heel insert 14 performs a plurality of functions: in a first and primary function when the footbed 16 is resting in engagement with the cupsole 12, the heel insert 14 reinforces the heel area of the otherwise flexible cupsole 12 so that it will not collapse under the load of the user. In a second and secondary function when access is needed to the concealed storage area (S), the heel insert 14 which is secured or attached to the footbed 16 allows the footbed 16 to be pivoted so it can be lifted up and away from the cupsole 12 to reveal a concealed storage area disposed within the heel insert 14. In this regard, the concealed storage space (S) within the container 30 has a sufficient volume for the storage of small personal items therein. In a third and final function, the heel insert 14 has a smooth contoured upper surface area or lid 32 which supports from below the heel of the user in a safe, comfortable manner. In short then, the heel insert 14 functions as: 1) a treasure chest for the storage of small loose items; 2) a rigid insert so that the otherwise flexible cupsole 12 will not collapse under the load of a user; and 3) a footbed 16 contouring device that allows the otherwise flat flexible footbed 16 to have a cup-shaped contour that provides the heel of a user with a smooth comfortable resting surface on the liftable footbed 16B.

As will be explained hereinafter in greater detail, the wedge-shaped cupsole 12 includes an open rear cavity area, generally indicated at 18 and a front footbed receiving space, generally indicated at 20. The open rear cavity area 18 is heel-shaped and is dimensioned for receiving therein the heel support member 14, while the footbed receiving space 20 is dimensioned for receiving therein the front or non-liftable portion of the footbed, indicated generally at 16A. The rear or liftable portion of the footbed indicated generally at 16B is received within a rear footbed receiving space or area 21 which forms part of the open rear cavity area 18 as will be explained hereinafter in greater detail. As best seen in FIG. 2, the heel support member 14 also cooperates with the cupsole 12 to support from below, in tandem, the footbed 16. More specifically, the cupsole 12 supports from below the non-liftable footbed 16A, while the heel support member 14 supports from below the liftable footbed 16B.

In order to hold the foot of a user in engagement with the footbed 16, the footwear 10 further includes a foot strap, indicated generally at 17, which is designed so that its strap wings may be sandwiched between the cupsole 12 and the footbed 16 and secured therein by an adhesive (not shown).

Considering now the novel method of using the novelty footwear item 10 in order to store and conceal small personal items within the storage unit 14, a user wearing the footwear 10, first removes the footwear item from his or her foot. Next, the user grapes a rear edge portion of the footbed 16 and lid 32 between his or her fingers and lifts the rear of the footbed 16 pivotally upward and away from the cupsole 12. In taking this action, the interior storage space (S) of the storage unit is exposed as best seen in FIG. 2 so that the user may place into the storage space (S) one or more small personal items, such as coins, a key, paper money and the like. Once the user has placed the items within the heel insert 14, the user lowers the rear of the footbed 16 until the liftable lid 32 comes into resting friction tight sealing engagement with the container 30.

Considering now the heel support member 14 in great detail, the heel support member 14 is composed of a rigid plastic material having a unitary construction that generally includes the hollow container 30, the liftable lid or closure 32 and a living hinge 61 which interconnects the container 30 to the lid 32. The heel support member 14 has an overall shoe heel shape which is dimensioned to be received within the open rear cavity area 18 of the cupsole 12. As best seen in FIGS. 17-18 the hollow container 30 of the heel support member 14 is integrally attached to the closure or lid 32 by a living hinge 61. This is an important feature of the present invention as the underside of the rear liftable footbed 16B is secured (by an adhesive not shown) to a top surface area 37 of the closure 32 so that when a user lifts the footbed 16 at about its rear end, the rear portion of the footbed 16B in turn, lifts the closure 32 upward and pivotally away from the container 30 to provide the user with access to the interior (S) of the hollow container 30.

Figure 5:
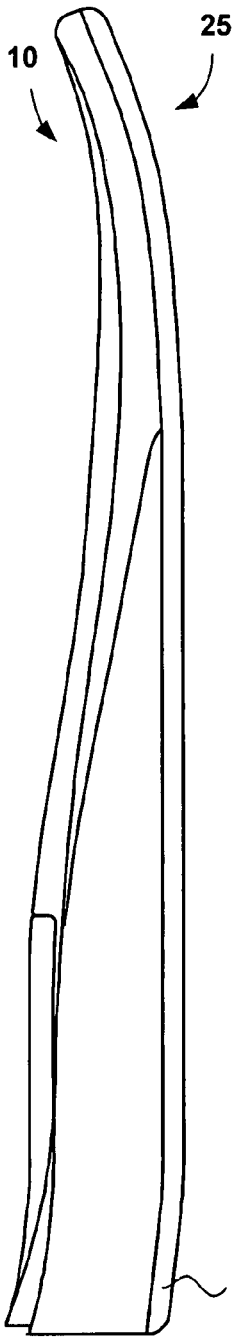
FIG. 5 is a right side elevational view of the novelty footwear item of FIG. 1.
Figure 7:
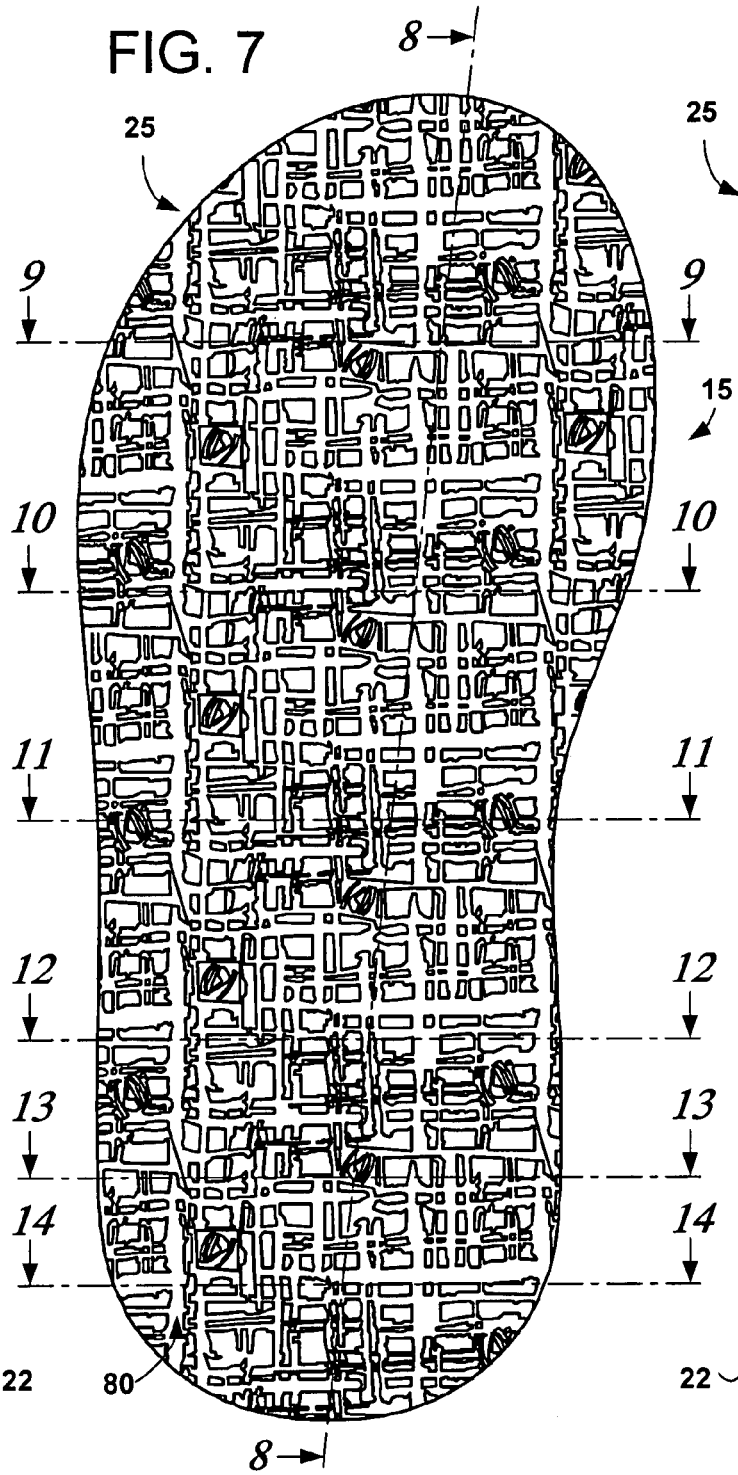
FIG. 7 is a bottom plan view of the novelty footwear item of FIG. 1.
Figure 6:
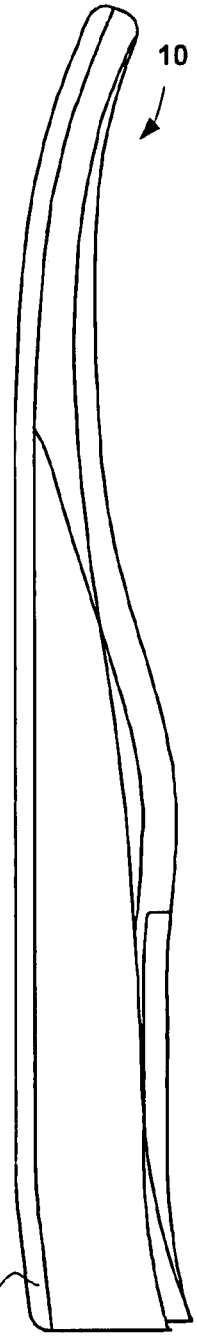
FIG. 6 is a left side elevational view of the novelty footwear item of FIG. 1.
Figure 8:
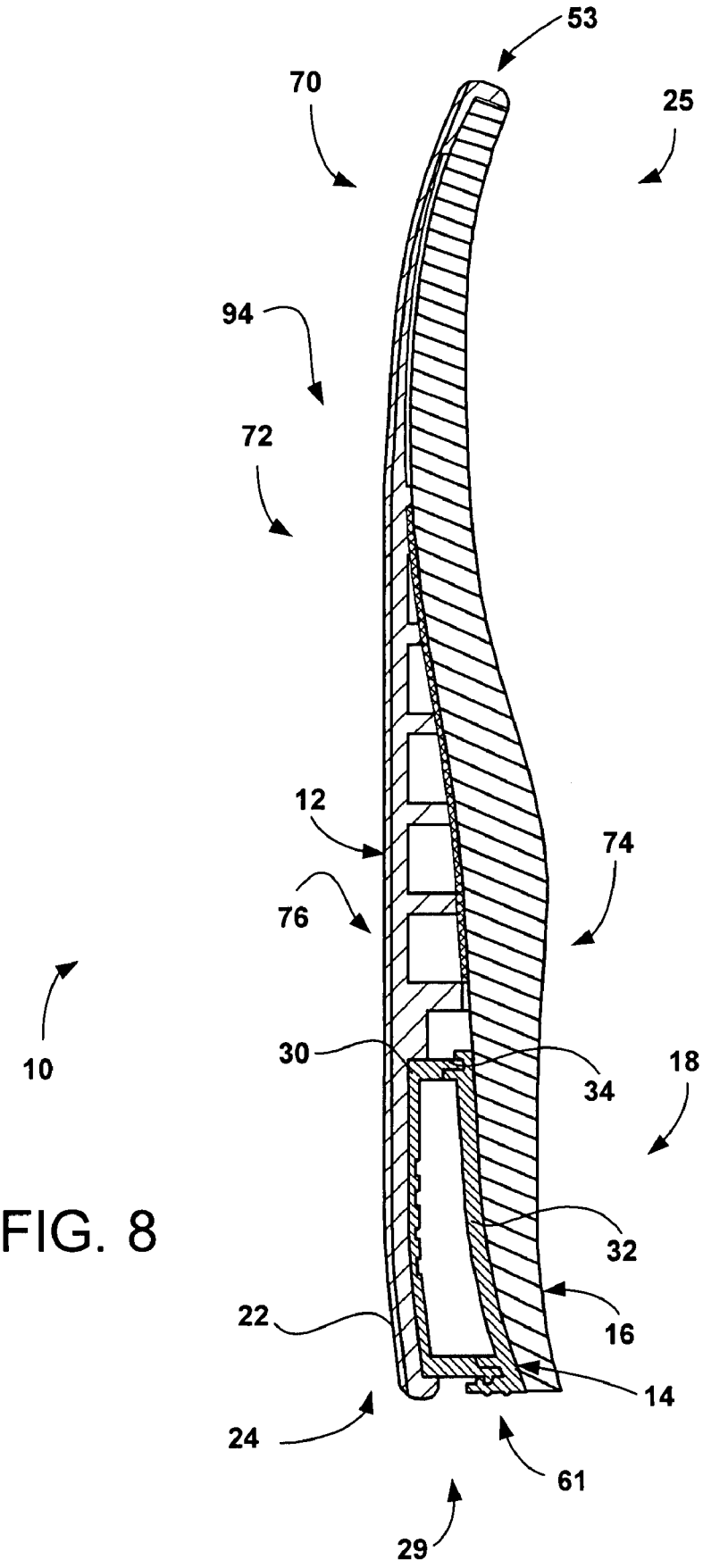
FIG. 8 is a sectional view of the footwear item of FIG. 7, taken substantially along line 8-8 thereof.
Figure 9:
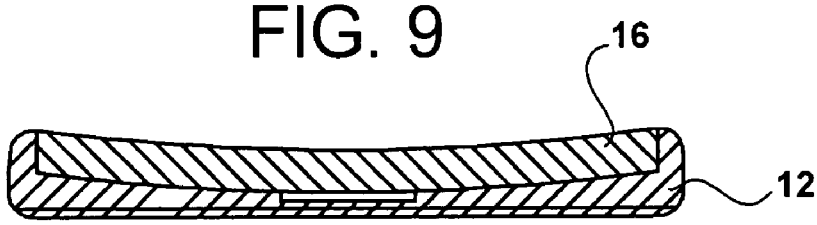
FIG. 9 is a sectional view of the footwear item of FIG. 7, taken substantially along line 9-9 thereof.
Figure 10:
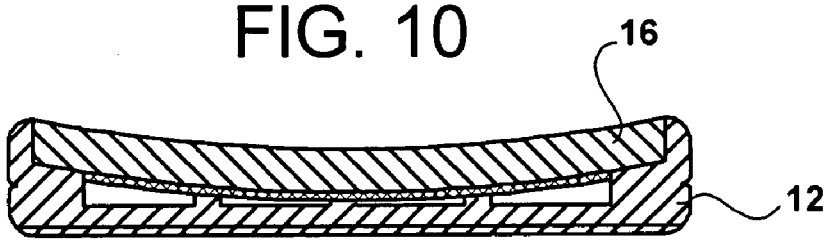
FIG. 10 is a sectional view of the footwear item of FIG. 7, taken substantially along line 10-10 thereof.
Figure 11:
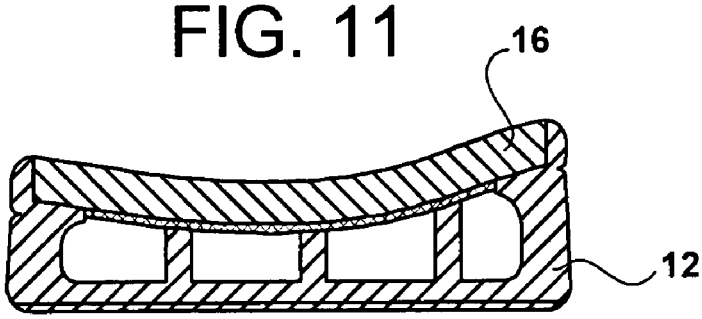
FIG. 11 is a sectional view of the footwear item of FIG. 7, taken substantially along line 11-11 thereof.
Figure 12:
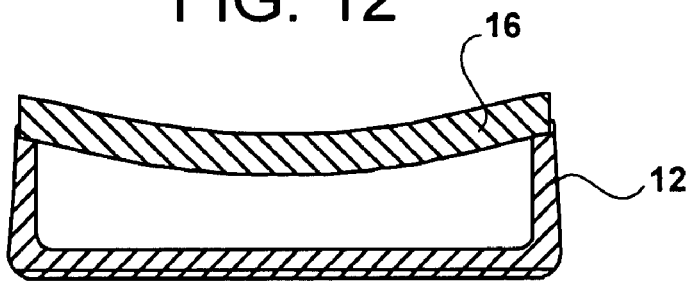
FIG. 12 is a sectional view of the footwear item of FIG. 7, taken substantially along line 12-12 thereof.
Figure 13:
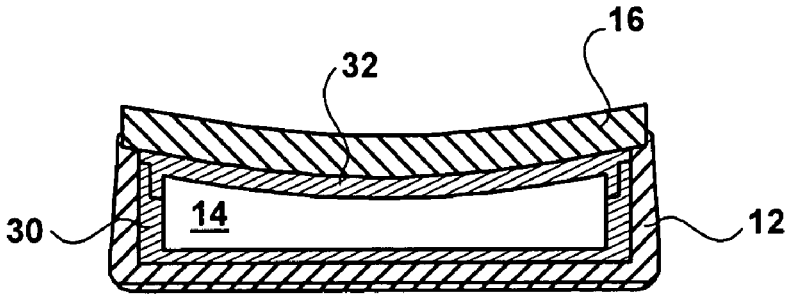
FIG. 13 is a sectional view of the footwear item of FIG. 7, taken substantially along line 13-13 thereof.

Considering now the wedge-shaped cupsole 12 in greater detail, the cupsole 12 has a unitary construction and generally includes an integrally formed lower outsole 22 with a predefined mold formed patterns 80 and 81 on its upper surface 83 and its lower surface 84 as best seen in FIGS. 1 and 7 respectively. The lower outsole 22 as best seen in FIGS. 5-6 and 8, supports from below an integrally formed upper midsole indicated generally 24. The upper midsole 24 is a sectioned member which generally includes three separate and distinct sections: a flexible front footbed supporting section 70, a recessed flexible honeycomb mid-section 72, and a rear heel cavity section 74 which is inclusive of a lid receiving section 76 and the open heel shape cavity 18.

Figure 16:
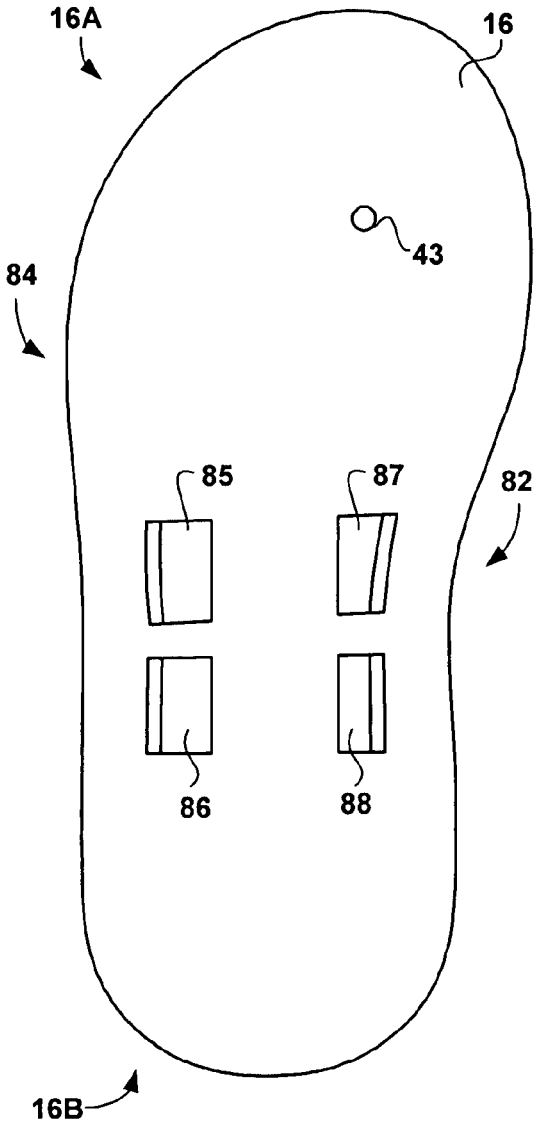
FIG. 16 is a bottom plan view of a footbed forming part of the novelty footwear item of FIG. 1.

As best seen in FIG. 16, the front footbed supporting section 70 and the recessed honeycomb mid-section 72 are enclosed by an open upwardly-wrapping sidewall indicated generally at 26. The sidewall 26 is open or terminates at an imaginary lateral boundary line (L) defining a forward boundary line of the rear heel cavity section 74. In this regard, the sidewall 26 is open at this rear boundary area thereby permitting the footbed 16 to be received in and support from below by the cupsole 12. Stated otherwise, the sidewall 26 acts as a retaining wall which is affixed to the front footbed 16A thereby securing it in a desired position relative to the cupsole 12. The sidewall 26 in this arrangement hides the side edge portions of the front footbed 16A retained behind the sidewall 26. This gives the primary two-piece footwear construction, inclusive of the cupsole 12 and the footbed 16, an overall unitary-like appearance.

It should also be appreciated by those skilled in the art, that by constructing the sidewall 26 so that it does not extend around the entire perimeter of the footwear 10, the rear footbed 16B is not retained by nor affixed to the sidewall 26 and therefore is free for lifting purposes. Stated otherwise, with the rear footbed 16B free of the sidewall 26 and the cupsole 12, the rear footbed 16B can be lifted away from the cupsole 12.

Figure 15:
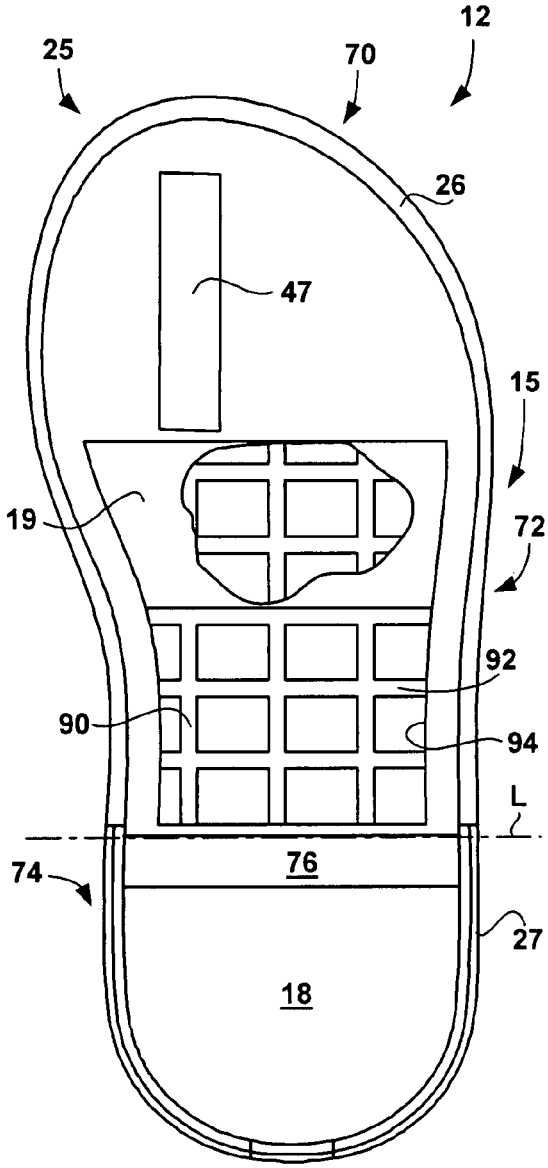
FIG. 15 is a top plan view of a cupsole forming part of the novelty footwear item of FIG. 1.
Figure 19:
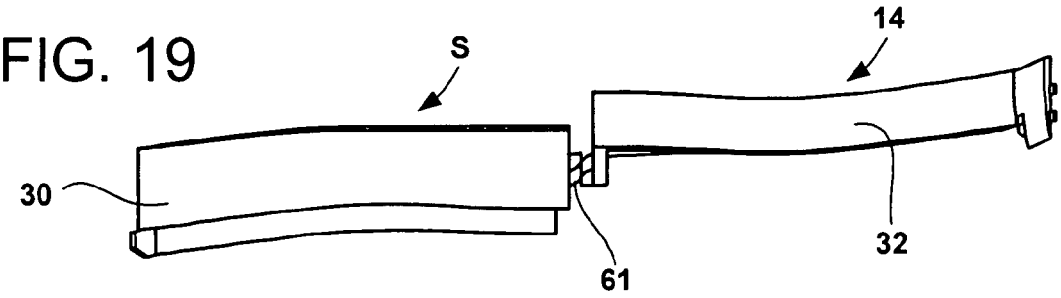
FIG. 19 is a side elevational view of the storage unit of FIG. 18.
Figure 20:
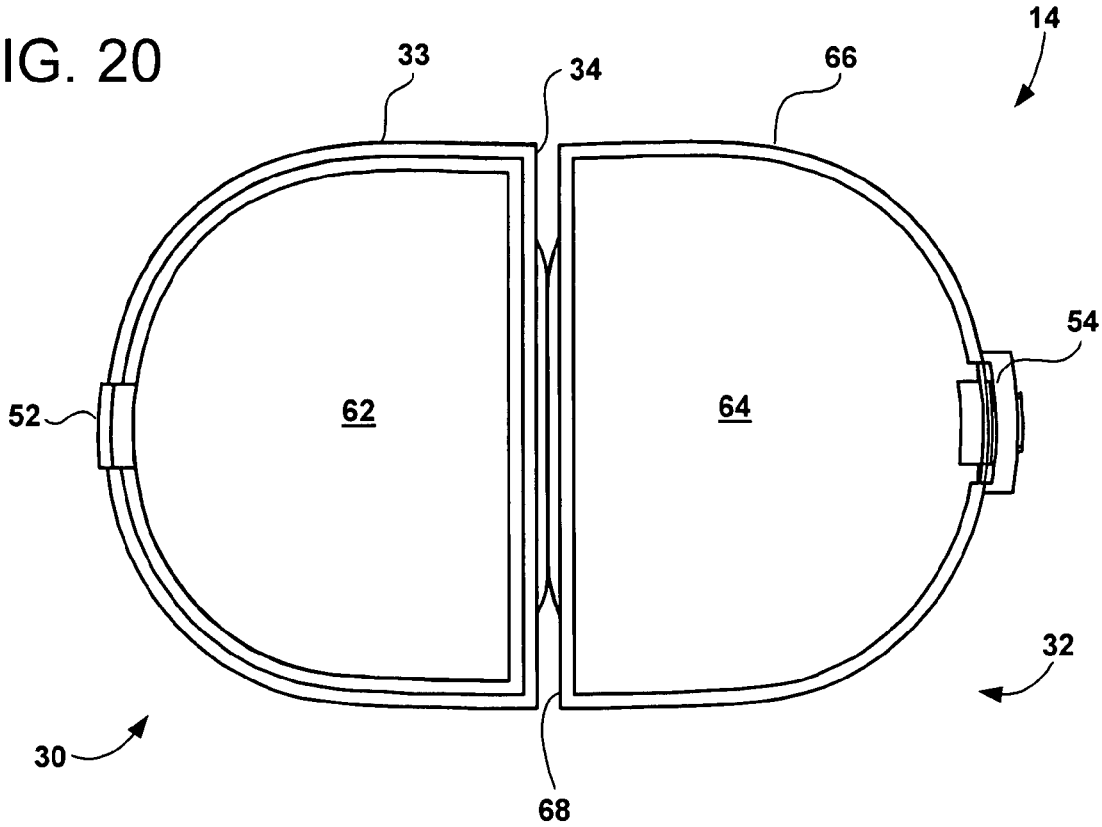
FIG. 20 is a top plan view of the storage unit of FIG. 18.
Figure 21:
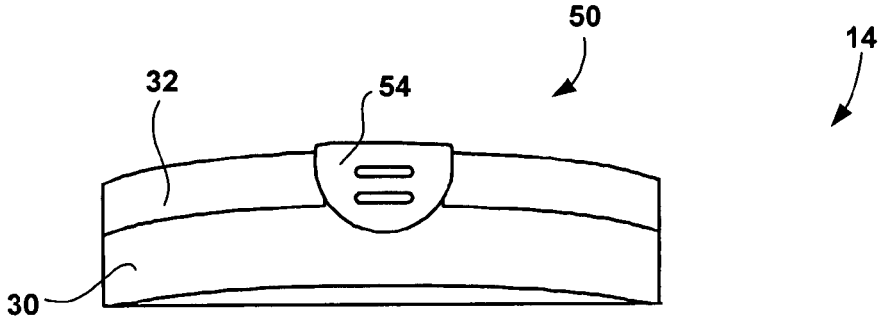
FIG. 21 is a rear elevational view of the storage unit of FIG. 17.
Figure 26:
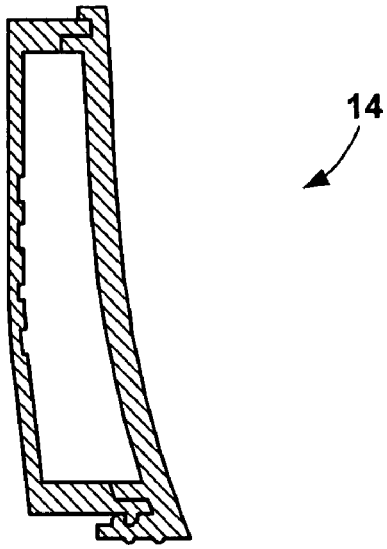
FIG. 26 is a sectional view of the footwear item of FIG. 22, taken substantially along line 26-26 thereof.
Figure 27:
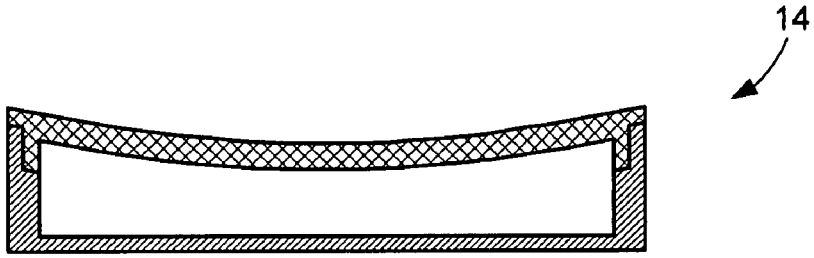
FIG. 27 is a sectional view of the footwear item of FIG. 22, taken substantially along line 27-27 thereof.
Figure 28:
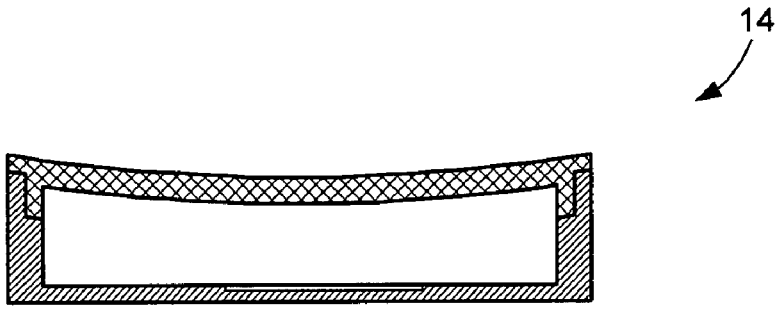
FIG. 28 is a sectional view of the footwear item of FIG. 22, taken substantially along line 28-28 thereof.

Considering now the recessed flexible honeycomb mid-section 72 of the cupsole 12 with reference to FIGS. 8 and 15, the flexible honeycomb mid-section 72 includes a centrally disposed lattice or network 69 of rib members, such as the rib member 90 and 92, which are tiered and crossed with one another forming the lattice network of ribs. The honeycomb mid-section 72 is generally rectangular in shape defined by a recessed wall indicated generally at 94. In this regard, the flex inhibiting shank 19 is received on and supported from below by a front portion of the lattice network 69 as best seen in FIG. 15. The lattice network of ribs within the honeycomb mid-section 72 provides the arch area 15 of the footwear with some flexibility notwithstanding the present of the flex inhibiting shank 19. This is an important feature of the present invention, since the lattice network of ribs 69 not only reduces the weight and cost of the footwear item 10, but it also provides a safe and comfortable arch support for the user.

In order to provide the footwear 10 with an aesthetic appearance, the height of the sidewall 26, is selected to be substantially the same dimension as the thickness of the footbed 16. As noted above, this is an important feature of the present invention since the side edge of the rear footbed 16B provides an illusion that the sidewall 26 continues beyond it termination because of the side elevational transition from the sidewall 26 to the side edge of the rear footbed 16B.

Also as best seen in FIG. 16, the cupsole 12 also includes a rear upwardly wrapping sidewall indicated generally at 27. The sidewall 27 extends upwardly from the lower outsole 22 and is supported from below by the lower outsole 22. In this regard, the rear sidewall 27 helps define the outer periphery dimension of the rear heel cavity section 74.

As best seen in FIG. 15, the rear sidewall 27 has a sufficient width dimension to support from below an outer edge portion of the footbed 16, and more particularly, an outer portion of the rear footbed 16B. However, that portion of the rear footbed 16B resting on the rear sidewall 27 is not affixed thereto, but instead is free to move. The remaining portion of the rear footbed 16B is affixed to and supported from below by the heel support member 14. The above-described structurally arrangement between the rear footbed 16B, the sidewall 27 and the heel support member 14 is an important feature of the present invention since the rear footbed 16B is free of the sidewall 27 it may be lifted in unison with the lid 32 and pivoted upwardly away from the cupsole 12. In short, the rear footbed 16B can be raised pivotally upwardly, without a direct hinge being disposed on the footbed 16, to an open position or it can be lowered to a fully closed and locked position. This is a unique and novel feature of the rear footbed 16B since it functions as if it was hinged to the front footbed 16A. This arrangement also provides the footwear 10 with an attractive stylish appearance where the front sidewall 26 and the rear sidewall 27 cooperate with one another to provide the footwear 16 with a very pleasing side elevational appearance, whether viewing the footwear 10 from an outside elevational view as shown in FIG. 5 or an inside elevational view as shown in FIG. 6.

Considering now the footbed 16 in greater detail with reference to FIGS. 5-6 and 8, the footbed 16 is of contour and size to substantially correspond to the lower surface of the cupsole 12 from the front to the rear of the footwear 10. The footbed 16 has a strap hole 43 at its front area which extends through the footbed 16 to the underside of the footbed 16 as illustrated in FIG. 15. In this regard, the strap hole 43 is located in alignment with a strap receiving recess area indicated generally at 47 disposed in the front footbed supporting section 70 of the cupsole 12. The strap receiving recess area 47 is generally rectangular shape and has sufficient depth, width and length dimensions for receiving therein a set of end straps that form part of a strap assembly 17. As the strap assembly 17 is conventional and is more fully described in U.S. patent application Ser. No. 11/595,095, which application is incorporated herein as though fully set forth, the strap assembly 17 will not be described herein in greater detail.

Considering now the cupsole 12 in greater detail with reference to FIGS. 2, 4, and 8-15, the rear sidewall 27 has a uniform construction except for a U-shaped cutout 29 which is disposed at its apex at the distal end of the footwear 10. As will be explained hereinafter in greater detail, the cutout 29 is dimensioned for providing the user with easy access to a releasable latching lock 50 which forms part of the heel insert 14.

Considering now the heel insert 14 in greater detail with reference to FIGS. 13-14 and 17-28, the hollow heel shape container 30 is dimensioned to be received within the open heel shape cavity 18 in a friction tight fix. In order to make certain that the container 30 is secured to the upper surface area of the lower outsole 22, the underside of the container 30 is coated with a suitable layer of adhesive. In this manner the container 30 is fixed to the lower outsole 22.

As best seen in FIGS. 23-24, the lid or closure 32 is contoured rising from front to rear in order to help facilitate properly supporting from below the heel of the user. The top surface area of the closure 32 is permanently fixed to underside of the footbed 16 by a suitable adhesive. This is an important feature of the present invention as it allows the footbed 16 to be lifted and pivoted in unison with the closure 32 to provide the user with access to the interior storage space (S) of the container 30. In a similar manner, when the user lowers the liftable portion of the footbed 16B, the footbed 16 and the closure 32 are closed in unison.

Considering now the heel insert 14 in still greater detail, as best seen in FIG. 18, the container 30 has a container face member 62 having extending upwardly from its periphery an outside wrapping sidewall 33 and a container front wall 34. The outside sidewall 33 and front wall 34 each terminate at an upper outer lip 35. Projecting upwardly from an interior periphery of the upper outer lip 35 and the front wall 34 is an integrally attached hinge receiving wrapping inside sidewall or closure stopping sidewall 60. The hinge receiving inside sidewall 60 terminates at an upper inner lip 36. The upper outer lip 35 and the upper inner lip 36 cooperate together and function as a stop for the closure 32 when it comes into closing engagement with the container 30. Extending outwardly from the inside sidewall 60 is an integrally formed latch 52 which forms part of the releasable latching lock 50.

Considering now the closure 32 in still greater detail with reference to FIG. 18, the closure 32 generally includes a closure face member 64 having extending upwardly from its periphery an outside wrapping sidewall 66 and a closure front wall 68. The sidewall 66 and front wall 68 terminate in a closure upper lip 40.

As best seen in FIG. 18, the living hinge 61 is disposed between the container front wall 34 and the closure front wall 68. A finger-engageable latch or lock release 54, which forms part of the releasable latching lock 50, is disposed on the upwardly-wrapping lock receiving sidewall 66 for lockingly engaging the latch 52. As best seen in FIG. 25, the finger-engageable lock release 54 is positioned within the cutout 29 when the heel insert 14 is secured within the open rear cavity area 18. This releasable latching lock 50 prevents the closure 32 from opening and thereby makes certain that the rear of the footbed 16 will not accidentally lift away from the cupsole 12.

Considering the cupsole 12 in still greater detail with reference to FIGS. 8-14 and 16, the cupsole 12 includes at about insole area a honeycomb rib structure 69 which provides the midsole area of the footwear with good foot support and which structure 69 cooperates with a flexible shank 58 to provide the footwear with some flexibility for walking purposes. As best seen in FIG. 8, a shank receiving space, indicated generally at 59 is provided partially between the cupsole 12 and the footbed 16.

Considering now the footbed 16 in greater detail with reference to FIG. 14, the footbed 16 is adapted to receive thereon the strap assembly 17. In this regard, the footbed 16 includes a set of paired and spaced apart strap slots, indicated generally at 82 and 84 respectively and a set of strap receiving areas indicated at 85-88. The strap slots are each dimensioned for passing therethrough a support strap end which is secured to the underside of the footbed 26. Again, a similar strap assembly is describe in U.S. patent application Ser. No. 11/595,095, which application is incorporated herein as though fully set forth, so the manner in which the strap assembly 17 is secured to the footbed 16 will not be described herein in greater detail.

As already described, the novelty footwear item 10 provides several unique and novel features not otherwise found in conventional footwear construction. The invention therefore, in its broader aspects is not limited to the specific details and representative embodiments shown and described herein. For example, although in the preferred embodiment sandal type footwear has been described, it is contemplated that a shoe with an upper having an attached footbed could be modified in accordance with the disclosed invention. Accordingly, various other modifications may be made without departing from the spirit and scope of the general inventive concept as defined by the appended claims and their equivalents.

We claim:

1. A novelty footwear item, comprising:

a footbed;

a heel-shaped storage unit having an integrally attached liftable lid; and wherein said footbed and said storage unit are mounted within a wedge-shaped cupsole so that a rear portion of the footbed overlays and conceals the storage unit;

wherein said rear portion of said footbed is attached to said liftable lid so as said rear portion of said footbed is lifted it pivots up and away from said cupsole in unison with said lid to provide user access to an interior storage space within said heel-shaped storage unit.

2. A novelty footwear item, comprising:

a wedge-shaped cupsole having an integrally formed lower outsole and an integrally formed upper midsole;

a lower wrapping side wall extending upwardly from said lower outsole for defining a heel cavity;

an upper wrapping side wall extending upwardly from said upper midsole for defining a footbed cavity;

a heel-shaped storage unit disposed within said heel cavity, said heel-shaped storage unit having an integrally attached liftable lid;

a hingeless footbed having a front footbed portion and a rear footbed portion, said hingeless footbed being pivotable about an imaginary line extending between said front portion and said rear portion thereof; and wherein said front portion is permanently affixed within said footbed cavity; and wherein said rear portion is permanently affixed to a top surface area of said liftable lid for concealing said heel-shaped storage unit and for enabling said hingeless footbed and said integrally attached liftable lid to be simultaneously pivotally lifted together to provide access to a concealed storage space within said heel-shaped storage unit.

3. A novelty footwear item, comprising:

a wedge-shaped cupsole having an integrally formed lower outsole and an integrally formed upper midsole;

a lower wrapping side wall extending upwardly from said lower outsole for defining a heel shaped cavity;

an upper wrapping side wall extending upwardly from said upper midsole for defining a footbed shaped cavity;

wherein said lower wrapping sidewall has a cutout disposed therein for providing user access to said heel cavity;

a lid receiving cavity formed adjacent to said heel cavity wherein a forward boundary of said lid receiving cavity is defined by a rear wall of a honeycomb lattice network forming part of said upper midsole;

a heel shape container corresponding substantial in dimensions with said heel shape cavity and received therein in a friction tight fix;

said container having an upwardly projecting wrapping sidewall and an integrally attached upwardly projecting hinge receiving front sidewall;

wherein said hinge receiving sidewall includes an upper end having a radially inwardly disposed closure stopping sidewall;

wherein said upwardly projecting wrapping sidewall includes another upper end having a radially inwardly disposed upwardly-wrapping latch receiving sidewall;

wherein said upwardly-wrapping latch receiving sidewall is also a closure stopping sidewall;

a closure having a heel shape closure panel with an upwardly projecting hinge receiving front wall disposed about it front periphery and an upwardly projecting wrapping lock receiving sidewall disposed about its rear periphery;

a living hinge disposed between the container upwardly projecting hinge receiving front sidewall and the closure upwardly projecting hinge receiving front sidewall;

a latch disposed on said upwardly-wrapping latch receiving sidewall;

a finger-engageable disposed on said upwardly-wrapping lock receiving sidewall for lockingly engaging said latch;

said finger-engageable lock being positioned within said cutout to provide lock access to a user;

a hingeless footbed having a front footbed portion and a rear footbed;

wherein said front footbed portion is secured within said footbed shaped cavity;

wherein said rear footbed portion is attached to a top surface area of said closure to enable said hingeless footbed to be pivotally between said front footbed portion and said rear footbed portion to provide access to a concealed storage space within said heel shape container.

4. A novelty footwear item, comprising:

a footbed;

a heel-shaped storage unit having a liftable lid; and wherein said footbed and said storage unit are mounted within a wedge-shaped cupsole so that a rear portion of the footbed overlays and conceals the storage unit and pivots up and away from said cupsole in unison with said lid when the lid is lifted to provide user access to said heel-shaped storage unit;

wherein said wedge-shaped cupsole includes an integrally formed lower outsole and an integrally formed upper midsole;

wherein said front footbed is attached to said upper midsole;

wherein said storage unit has a unitary construction including a container and a living hinge for pivotally attaching said lid to said container; and wherein said lid is received on said container in a friction tight fit sufficient to hold said lid to said container in a sealed arrangement;

wherein said lid includes a finger engagable lift to help a user disengage said lid from said container when they are engaged in said friction tight fit;

wherein said container includes a latch and wherein said lid includes a latch receiving finger releasable lock;

wherein said latch and said latch receiving finger releasable lock are aligned with one another for releasable engagement when said lid is received on said container;

wherein said rear wrapping sidewall includes a cutout at about a rear portion of said rear sidewall; and wherein said cutout provides a sufficient space in said rear sidewall to allow a finger of a user to engage said latch receiving finger releasable lock to facilitate unlocking said lock to permit said footbed to be lifted up and away from said container.

5. The novelty footwear item according to claim 4, wherein said wedge-shaped cupsole includes a footbed cavity and a heel insert cavity;

wherein said storage unit is mounted within said heel insert cavity;

wherein said storage unit includes a container having said liftable lid pivotally attached thereto;

wherein said footbed includes a front footbed portion fixedly mounted within said footbed cavity; and wherein said rear footbed portion is attached to said lid to permit said rear footbed portion to be pivotally lifted relative to said front footbed portion to provide user access to said container.

6. The novelty footwear item according to claim 5, further comprising:

a lid receiving space disposed substantially between said footbed cavity and said heel insert cavity for receiving therein a portion of said lid as it is pivoted in unison with said rear footbed.

7. The novelty footwear item according to claim 4, wherein said wedge-shaped cupsole includes an integrally formed lower outsole and an integrally formed upper midsole;

wherein said front footbed is attached to said upper midsole.

8. The novelty footwear item according to claim 7, wherein said storage unit has a unitary construction including a container and a living hinge for pivotally attaching said lid to said container; and wherein said lid is received on said container in a friction tight fit sufficient to hold said lid to said container in a sealed arrangement.

9. The novelty footwear item according to claim 8, wherein said lid includes a finger engagable lift to help a user disengage said lid from said container when they are engaged in said friction tight fit.

10. The novelty footwear item according to claim 9 wherein said container includes a latch and wherein said lid includes a latch receiving finger releasable lock.

11. The novelty footwear item according to claim 10, wherein said latch and said latch receiving finger releasable lock are aligned with one another for releasable engagement when said lid is received on said container.

12. The novelty footwear item according to claim 4, wherein said footbed and said lid pivot simultaneously away from said container when said footbed is lifted.

13. The novelty footwear item according to claim 12, wherein said container is a heel shaped container.

14. The novelty footwear item according to claim 13, wherein said footbed has attached thereto a foot strap to enable said footwear item to be received and supported on said footbed.

15. The novelty footwear item according to claim 14, wherein said upper midsole includes a flexible front toe area and a flexible rear honeycombed lattice wall network area;

said rear honeycombed lattice wall network having a shank receiving space disposed therein to help limit flexing between said flexible front toe area and said flexible rear area.

16. The novelty footwear item according to claim 15, further comprising:

a flex inhibiting shank disposed within said shank receiving space for further helping to limit flexing between said flexible front area and said flexible rear area.

17. The novelty footwear item according to claim 16, wherein said footbed is resilient and sufficiently flexible to pivot in unison with said lid.

18. The novelty footwear item according to claim 7, a rear wrapping sidewall extending upwardly from said lower outsole; and a front wrapping sidewall extending upwardly from said upper midsole.

19. The novelty footwear item according to claim 18, wherein said front wrapping sidewall extends around a front periphery edge of said upper midsole and rearwardly therefrom along each respective periphery side edge of said upper midsole to define a retaining wall for said footbed cavity.

20. The novelty footwear item according to claim 19, wherein said footbed includes a side edge, a bottom surface and an upper surface;

wherein said lower outsole includes an upper surface and a lower surface;

wherein said side edge of said footbed is affixed to said front wrapping sidewall of said upper midsole;

and wherein the bottom surface of said footbed is affixed at least to a portion of said upper surface of said lower outsole.

* * * * *